United States Patent [19]

Ricca

[11] 4,135,358

[45] Jan. 23, 1979

[54] ATTACHMENT FOR AN ELECTRONIC WATCH SYSTEM

[76] Inventor: Tom L. Ricca, 1407 Wyandotte Rd., Columbus, Ohio 43212

[21] Appl. No.: 768,646

[22] Filed: Feb. 14, 1977

[51] Int. Cl.[2] ..... G04C 3/00

[52] U.S. Cl. ..... 58/23 R; 58/50 R; 200/159 R

[58] Field of Search ..... 58/23 R, 23 BA, 50 R, 58/88 R; 200/86 R, 159 R, 159 B, 159 A; 240/2.1, 6.43

[56] References Cited

U.S. PATENT DOCUMENTS

| | | | |
|---|---|---|---|
| 3,224,184 | 12/1965 | Brien | 58/50 R |
| 3,392,247 | 7/1968 | Check | 200/86 R |
| 3,681,587 | 8/1972 | Brien | 240/2.1 |
| 3,812,313 | 5/1974 | Wolf et al. | 200/86 R |
| 3,911,664 | 10/1975 | Haber | 58/23 R |
| 3,914,933 | 10/1975 | Carlone | 58/50 R |
| 3,924,400 | 12/1975 | Carlone | 58/50 R |
| 3,971,206 | 7/1976 | Martino | 58/88 R |

*Primary Examiner*—Robert K. Schaefer
*Assistant Examiner*—Vit W. Miska

[57] ABSTRACT

An attachment for an electronic watch worn on a wrist has a plate linked to an electric switch and moving about a support secured at such a location on the watch system that the wrist can be brought about to press said plate against a firm surface for a duration and a number of times to select and cause the displaying of a set of watch data. This firm surface can be anything around the watch wearer's body or parts thereof, but not absolutely a finger on the side of the wrist not wearing the watch.

2 Claims, 7 Drawing Figures

ATTACHMENT FOR AN ELECTRONIC WATCH SYSTEM

BACKGROUND OF THE INVENTION

This invention relates to an electronic watch and more particularly to an attachment for an electronic wrist watch that allows to activate the displaying of a set of watch data such as horological data, with only one hand of said watch wearer.

In order to aid understanding of this invention and to simplify the disclosure thereof, the following definitions are submitted:

a. Conventional electronic watches: electronic watches that do not embody the present invention.

b. A set of watch data: a set of data generated by the electronics of a watch which has any kind of attachment on its case and its band. Beyond horological data, it is conceivable that a future watch, with more sophiscated electronics and attachments, can provide many more kinds of data, a set of which can be selected for display by action of a switch in a sequential manner or in combination with a plurality of other switches.

c. A watch system: a conglomeration composed of a case containing most parts of the watch, a band attached to said case, means to secure said band around the left or right wrist of a person, and any attachment secured to said case and band.

d. Two-hand operations of a watch: operations in which the watch wearer has to move simultanuously his one hand which is near the wrist wearing the watch and another hand, whether his own second hand or somebody else's, in order to cause the displaying of a set of watch data.

e. One-hand operations of a watch: operations in which the watch wearer has to move only the one wrist that wears the watch in order to cause the displaying of a set of watch data.

A conventional watch of the type having digital display with light-emitting diodes requires the pushing of a certain button located on the case of said watch in order to activate the electronic circuit for the displaying of a set of data of said watch, typically a set of horological data such as time, day of the week and date of the month. Some watches of the type aforementioned allow several sets of data of the same watch to be displayed consecutively with consecutive pushings of a single button on the case of said watch. This practice of activating the display only when necessary is observed to conserve the energy of the watch batteries so that they need be changed only about once a year in normal use.

A major objection to purchasing and using one of these conventional watches is the fact that, while wearing such a watch on the wrist of one hand, the pushing of any of the buttons located on the case of said watch can be done only in a practical manner with the wearer's second hand which is connected to the wrist that does not wear said watch at that particular moment. Unfortunately, this wearer's second hand is not always available.

The aforementioned objection still persists with another type of conventional watches which are equipped with a set of liquid-crystal display. Although displaying continuously one particular set of data, said watches would require also a two-hand operation in the case when the wearer wants to read a set of data other than the one being displayed, or in the case when the wearer wants to read the display in the dark and said watches are equipped with a light-radiating means that requires a button on the case of said watches to be pushed for reading of the liquid-crystal display in situations when ambiant light is not bright enough.

Thus, these two-hand operations of conventional electronic watches as discussed above are not convenient, or worse still, not safe, easy or possible in many situations when a normal wearer of such a watch is engaging in a normal activity such as driving a car, piloting a plane, writing, holding a glass, dancing, embracing someone etc.

Another type of conventional watch with light-emitting-diode display permits one-hand operations by shaking the wrist wearing such a watch in a definite movement to cause a mercury switch to turn on the display; but such movement is relatively vigorous and restricted to a certain pattern, hence inconvenient and awkward. Besides, the prices of these watches are relatively high because of that one-hand operation feature.

Overcoming the above difficulties in the operation of an electronic watch equipped with a digital display, the present invention is designed to eliminate the troublesome problems by providing a low-cost means of activating a selected display of an electronic watch equipped with digital display, by a slight and unconspicuous movement of only the wrist wearing said watch.

SUMMARY OF THE INVENTION

The present invention is provided with a plate moving about a support so positioned on a conventional electronic watch system as to allow the wearer of such watch to put enough pressure on said plate by hitting slightly with a movement of the sole wrist wearing said watch, on any one of a multitude of firm surfaces found conveniently around said watch, said surfaces being characterized by a chair arm, a table top, the steering wheel of a car that said wearer is driving, and many parts of his own body such as the parts between the chest and the abdomen, and also the hip on the side of the body where the watch is located. This plate has means to activate, with the pressure aforementioned, one of the general classes of electrical switches to turn an electrical path from one state into another one of the two states of high and low resistance as required by the electronics of said watch, to cause the displaying of the selected watch data. While being out of the way of anything that in good probability can cause involuntary hitting on it, said plate can be brought conveniently into a position in front of at least one of said firm surfaces any time, so that the hitting of said plate on said firm surface will look like a natural movement that would precede the glancing at the display which usually would be activated for a duration of typically about one and a half seconds by the watch electronics.

The principal object of this invention is to provide an attachment to a conventional watch system that allows the wrist wearing said watch to be brought about to hit slightly on a plate of that attachment on any firm surface to activate a switch linked to said plate and cause subsequently the displaying of, for instance, the most often-wanted set of data of said watch. This action of hitting said plate on any firm surface requires only a movement of the wrist wearing said watch; thus, the invention provides one-hand operations to a conventional electronic watch embodying such an attachment. This watch can still retain all the conventional parts, including the switch located on the case originally designed to activate the most often-wanted watch data, said switch being connected electrically to the switch on the attachment in a manner well known to the people in the art, to permit the switch on the attachment to work without disturbing the eventual operations of the original switch located on the case of said watch. This object of the invention thus allows existing watch manufacturers to incorporate the present invention into their electronic watches without having to change much in the design of their lines of products.

A further object of the invention is to reduce by one the number of buttons on the case of a conventional electronic watch and to provide an attachment embodying a relatively low cost switch, and being of a size and at a location on a watch system chosen to bring about the one-hand operations of said watch. This object of the invention aims at reducing further the manufacturing cost of electronic watch systems which embody the attachment as an indispensible part.

A further object in an alternate embodiment of the invention is to provide a replacement watch band on which said attachment is positioned as discussed above to bring about one-hand operations to a conventional electronic watch, when this replacement band is attached to said watch and when electrical connections are established between the switch of the attachment and one of the switches originally provided for on the case of said watch. This object of the invention thus permits a good number of conventional watches already in use in a two-hand operation fashion to be converted easily, and at low cost, to a one-hand operation fashion.

A further object of the invention is to provide an innovative switch assembly which can be integrated into the attachment in order to bring about the result of one-hand operations to a conventional electronic watch system to which said attachment is secured.

Other objects and advantages of the invention will become apparent from the attached drawings, the claims and the following portion of the specification.

DETAILED DESCRIPTION

Figure 1:
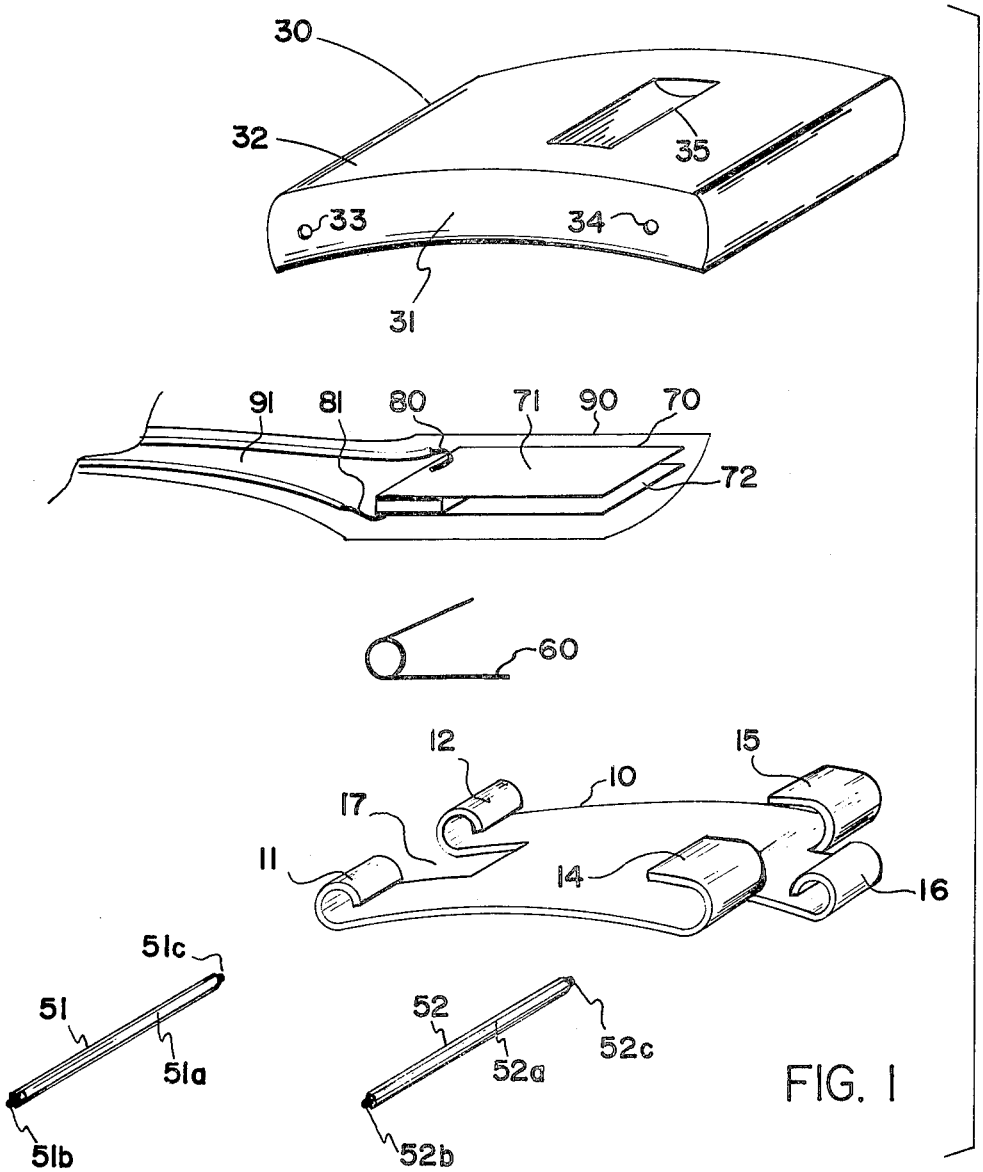
FIG. 1 shows the oblique pictural drawing of the attachment characterizing the invention.

Referring to the drawing of FIG. 1 the attachment characterizing the present invention comprises a support 10, a plate 30 to be secured to support 10 with the help of retractable pins 51 and 52, a spring 60 to be sleeved on pin 50 and bearing on support 10 and plate 30 to return always said plate 30 to a rest position after any pressure bringing said plate 30 closer to said support 10 has been removed, a switch 70, electric wires 80 and 81 attached to switch 70, and a plastic pouch 90 covering switch 70 and wires 80 and 81 up to the electronics of the watch system on which the attachment is secured, in order to protect them from damages caused by chemical attack, electrical contact, and mechanical breakage.

Support 10, made of firm material, preferably sheet brass of about 20 mils of thickness, has parts 11 and 12 formed essentially into two cylinders of about 60 mils of inside diameter to serve as bearings inside which retractable pin 51 can rotate freely around its longitudinal axis. Pin 51 of adequate length, of about 50 mils of diameter on the body 51*a*, and about 25 mils of diameter on the ends 51*b* and 51*c*, has at least one of the ends 51*b* or 51*c* pushable inside the body 51*a*, and expandable by itself again into normal position outside of body 51*a*, for the purpose of securing plate 30 on support 10 and allowing said plate 30 to swing around said pin 51 with respect to support 10. Pin 52, similar to pin 51 in all respects except probably in length, bears normally on the underside of U-shaped parts 14 and 15 of support 10 to determine the rest position of plate 30 which tends to move away from support 10 under the influence of spring 60. Part 16 of support 10 is also shaped into a cylinder to link to one portion of the watch band thereof support 10 is made an integral part. Another portion of the watch band is made to link to support 10 via pin 51. Support 10 also has aperture 17 to facilitate this last linkage and to allow part 91 of the plastic pouch covering the electric wires 80 and 81 to go under pin 51, through support 10, to reach the watch electronics. For mechanical strength support 10 can have embossed lines thereon, and for protection against oxydation, it can be chrome plated. Plate 30, made of firm material, preferably sheet brass or stainless steel of about 20 mils of thickness is formed so as to be fixable onto support 10 with the help of pins 51 and 52. For that purpose, its wall 31 is made practically perpendicular to surface 32 near the regions where wall 31 has circular apertures 33 and 34 of about 30 mils of diameter. On the side of plate 30 hidden in FIG. 1, a wall similar to wall 31 and parallel thereto, also has circular apertures similar to apertures 33 and 34. With pin 51 going through part 11, then spring 60, and then part 12, and pin 52 going under parts 14 and 15 of support 10, it is conceivable that dimensions of plate 30, support 10 and pins 50 and 51 and spring 60 can be determined with proper clearance to allow sleeving end 51*b* into aperture 33, end 52*b* into aperture 34 and ends 51*c* and 52*c* into apertures made for them on the hidden part of support 10 in FIG. 1, with just regular tools of a watch repairman. Secured in that manner, plate 30 can swing around the axis of pin 51 and cylinders 11 and 12, through an angle determined by two extreme positions of plate 30 with respect to support 10. The first position is the one in which the embossed part 35 on plate 30 causes the electrodes 71 and 72 of switch 70 to touch each other when enough pressure is put on plate 30 in the direction bringing it closer to support 10. The second position is the one where pin 52 bears on the underside of U-shaped parts 14 and 15 and stays there by action of spring 60, and where embossed part 35 of plate 30 moves away from said electrodes 71 and 72 causing them to move apart from each other by their own natural eleasticity. This second position is the one that plate 30 takes normally with respect to support 10 when aforementioned pressure is not involved. This second position is also dictated by the fact that plate 30 should protrude enough beyond the rest of the watch band so that when the part of the watch system around the plate 10 is brought to press against a firm surface such as a fully clothed part between the chest and the abdomen of the watch wearer, plate 30 will receive enough pressure to cause it to go to the aforementioned first position. Plate 30 can have decoration and plating thereon, if desired.

Figure 2:
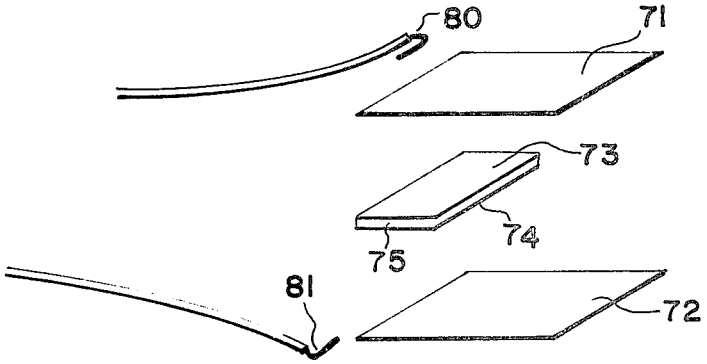
FIG. 2 shows the oblique pictural drawing of a switch suitable for the purpose of the invention.

In the present embodiment, switch 70 as shown in details in FIG. 2, is composed of two rectangular pieces 71 and 72 of elastic metal, preferably phosphor bronze of dimensions about 500 mils × 200 mils × 5 mils, each of which having one of its ends lying flat on, and soldered to, each of the copper-clad sides 73 and 74 of a piece of double-sided, copper-clad board of insulator 75, preferably glass-epoxy, of dimensions about 200 mils × 100 mils × 20 mils, said copper-clad sides having attached thereto by soldering on the two sides 73 and 74, two electric wires 80 and 81, preferably silver-covered copper wires of 30 gauge. Also in the present embodiment, plastic pouch 90 in FIG. 1 covers switch 70 and wires 80 and 81 in a water-tight manner up to a point in the watch system where wires 80 and 81 can be connected to the watch electronics. This pouch 90, of selected plastic of proper thickness, is sealed with heat at the proper place so as to be elastic and to allow the two electrodes 71 and 72 to remain separated with a distance of about 20 mils when no pressure is put on plate 30 to bring it closer to support 10, and yet to allow readily said electrodes 71 and 72 to be pushed to touch each other when pressure is put on plate 30 to cause embossed part 35 to bear on electrode 71 via said pouch to push it against electrode 72 which is immobilized by support 10 via said pouch. The part of pouch 90 covering the wires 80 and 81 is heat sealed into one narrow laminated strip 91 that goes, by means of aperture 17, out of the enclosure formed by plate 30 assembled onto support 10. This strip 91 continues from there to go underneath the watch band in one embodiment, or within the watch band body in another, to reach the watch electronics located in the watch case or in any part of the watch system.

Figure 5:
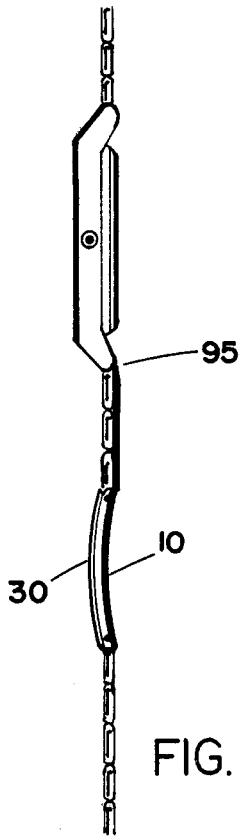
FIG. 5 is a side view of the invention shown in FIG. 4, but in elevation.

Near the junction 95 seen in FIG. 5 between the watch case and the watch band where bending may be sharp, said strip 91 can be arranged to have strain relieving means to avoid mechanical breakage. One preferred way is to arranged so that there would be no possible sharp bending at said junction by some stiffening schemes. These are not shown because they can be conceived readily when the design of the watch system is decided upon. The switch described in this embodiment is usable on any attachment; but it fits particularly water-tight electronic watches to which it brings about the one-hand operations of the invention without decreasing their degree of water-tightness.

Figure 3:
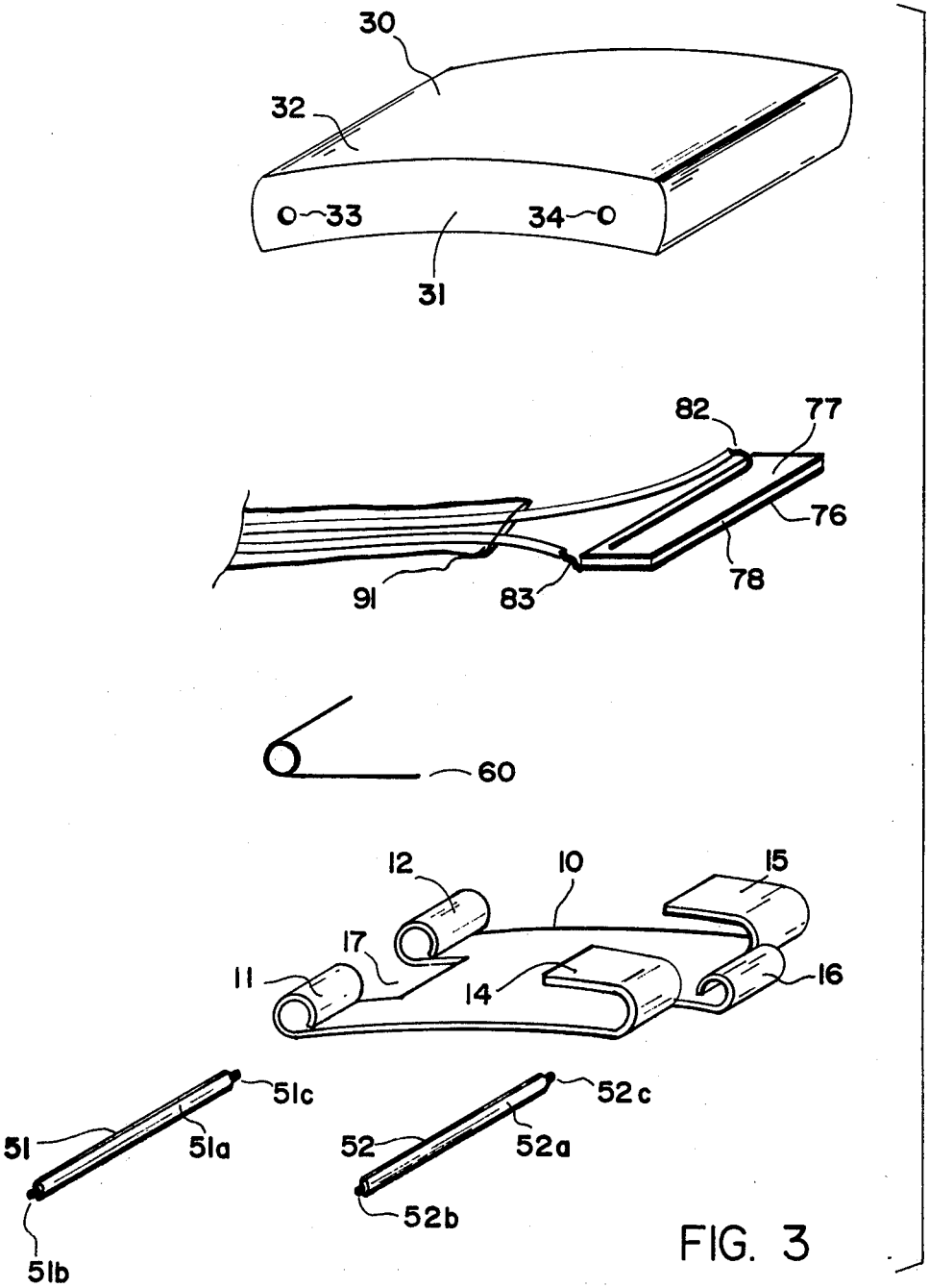
FIG. 3 shows the oblique pictural drawing of another switch suitable for the purpose of the invention.

FIG. 3 shows another embodiment of the invention wherein said switch is a combination of a rectangular piece 78 of double-sided, copper-clad insulator, preferably glass-epoxy, of dimensions about 250 mils × 125 mils × 20 mils soldered on one copper-clad side 76 thereof onto parts 14 and 15 of support 10, an electric wire 82, preferably silver-coverd copper of 30 gauge, soldered on the other copper-clad side 77 of said copper-clad board, in such a manner that said wire at that soldered portion will touch the underside of metallic plate 30 when pressure is put on said plate to bring it closer to metallic support 10 and said electric wire running along, with another similar electric wire 83 soldered to part 15, up to the electronics of said watch system for electrical connections. As plate 30 in this preferred embodiment is made of metal, as well as pin 50, it is electrically connected to part 15 of support 10 and thus form with electric wire 82 that it can be made to touch, the electrodes of a switch for the purpose of the invention. These two wires are protected by the plastic laminated strip 91 as discussed in the first embodiment. Embossed part 35 described in the first embodiment is no longer needed in this embodiment, and thus omitted in FIG. 3.

Figure 4:
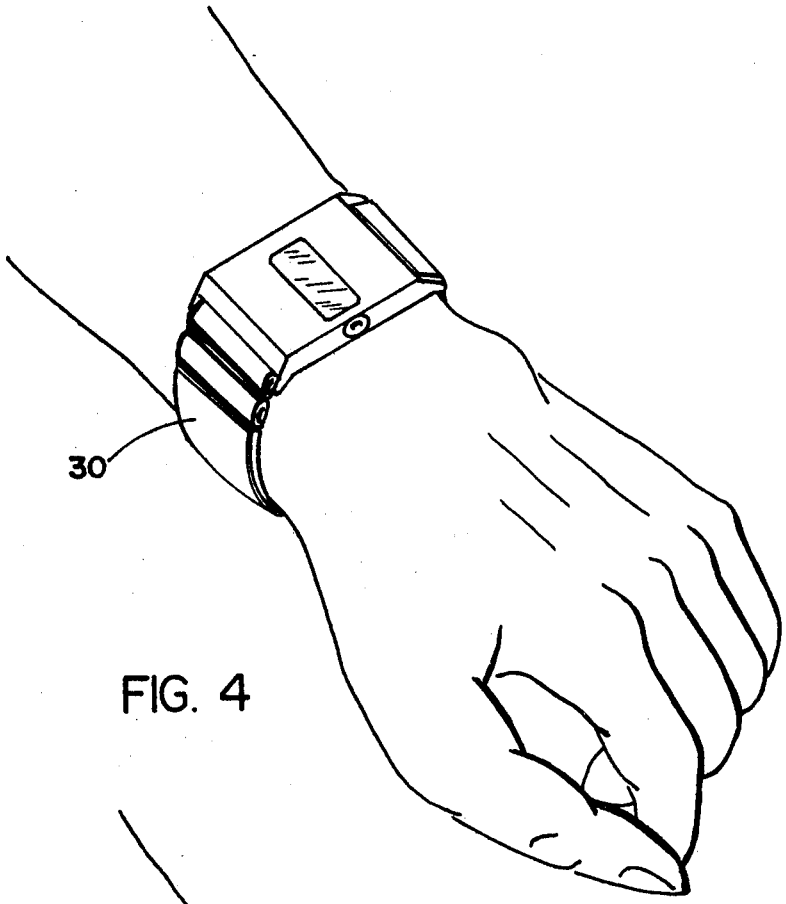
FIG. 4 is a perspective drawing of the invention on a watch worn on a wrist.

FIG. 4 shows support 10 of the attachment being secured on a watch system worn around the left wrist of a person. Plate 30 covering support 10, is seen at a location centered around the approximately straight imaginary line extending from the thumb of the left hand of said person into his left arm, or stated in another way, at a location between 45 degrees and 145 degrees of trigonometric angle from the case of said watch, if the direction of viewing is from the tip of the fingers toward the wrist of said hand. It is found by experimentation that this location is to be preferred because, in operation, it avoids involuntary pressure on plate 30 in normal activities of said watch wearer, but allows said wrist to be brought about, at a certain moment, to press a region of said plate against any firm surface conveniently found around said wrist, such as the hip and any part between the abdomen and the chest of said watch wearer, a chair arm, a table top, the steering wheel of the car that said watch wearer is driving. Such pressing on said plate is to be executed for a duration and a number of times as recommanded by the manufacturer of said watch, for the purpose of causing the display of a selected set of data of said watch to appear, without requiring the movement of a wrist other than the one wearing said watch at said moment.

Figure 6:
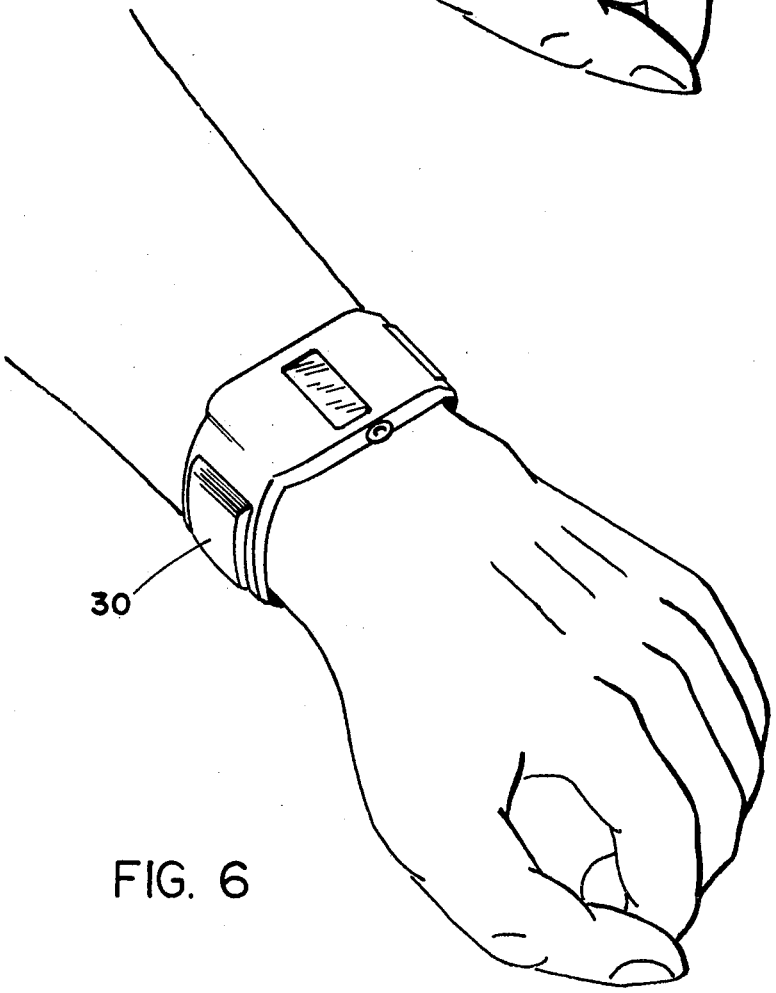
FIG. 6 shows a modified embodiment of the invention on a watch worn on a wrist.
Figure 7:
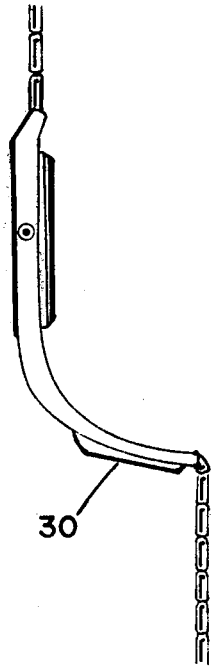
FIG. 7 shows a side view of the invention shown in FIG. 6, but in elevation.

It is to be understood that support 10 of the attachment can be secured easily to the case of a watch system as shown in FIG. 6 and FIG. 7. In this preferred embodiment, the case of the watch system is so shaped as to help maintain said support 10 at the aforementioned critical location. This embodiment lends itself well to situations therein the case of a novelty watch is to be made with high-impact plastic to lower the cost of manufacturing. It is also conceivable that the advantages of the present invention can be incorporated into a watch system which is made in such a way that its case and band form an integral unit that extends from one part to another one essentially with continuity, provided that support 10 and plate 30 be secured on such watch system at said critical location.

This invention applies also to an electronic watch worn on the right-hand wrist, if said watch, having support 10 secured on the watch system at said critical location described for the left-hand wrist, is transferred to be worn on the right-hand wrist in such a way as to permit the wearer to read the display of said watch right side up.

Finally, the display of the electronic watch embodying the invention can be of any type such as light-emitting-diode, liquid-crystal, or a type possibly to be invented. As long as the electronics of the watch requires that a button be pushed to bring about the appearance of a set of selected data, this invention proves to be useful.

The invention having been described in its preferred embodiments, it is clear that it is susceptible to numerous modifications and embodiments within the ability of those skilled in the art, and without the exercise of the inventive faculty.

I claim:

1. In a watch system comprising a case containing most parts of the watch, a band attached to said case, means for securing said band around a wrist of a person, the electronics of said watch system requiring a momentary change in the conductivity of one electrical path to cause the display of a selected set of data of said watch to appear, a wrist actuator for said momentary change in the conductivity comprising:

a. a support made of one of the general classes of firm materials characterized by brass, stainless steel and hard plastics, having essentially the shape of a rectangle thereof the first two sides parellel to each other has length about the same as the width of said band and the two remaining sides are oriented essentially in the longitudinal direction of said band;

b. said support having essentially cylindrical bearings suitably formed at one of said first sides and longitudinally oriented in the same direction as said first sides;

c. said support having U-shaped formings at the other side of said first sides;

d. means for fastening said support to said watch system at a location between 45 degrees and 145 degrees from the case of said watch;

e. a plate made of one of the general classes of firm materials characterized by brass, stainless steel and hard plastics having essentially the shape of a thin-walled rectangular box thereof with one of the two largest sides missing f. the remaining largest side of said plate having a boss of suitable shape and size located near the center of said side and protruding toward the inside of said rectangular box;

g. means for fastening rotatably said plate to said bearings of said support to make them form essentially together a complete six-sided box;

h. spring means for permanently causing a swinging of said plate around said bearings and away from said support with suitable strength in the absence of any external force;

i. means for putting a first stop on said swinging at a suitable distance between said plate and said support, said means for putting said first stop being characterized by a retractable pin of adequate diameter fastened at its both ends onto said plate by means of apertures suitably provided for on said plate and the longitudinal part of said pin being caused to rest on the inside of one of the legs of said U-shaped formings by action of said spring means;

j. an electronic switch characterized by two strips of elastic metal fastened on opposite sides of a suitably dimensioned board of insulator at one end and causable to touch each other at the other end by forces tending to bring said strips closer to each other;

k. means for establishing said electrical path between said switch and the electronics of said watch system;

l. means for insulating electrically said switch from said plate and said support;

m. said switch being fastened between said support and said plate and suitably dimensioned and positioned to cause said strip to touch each other by simultanous action of said boss and said support on said strips when adequate pressure is exerted in the manner that brings said plate closer to said support and to move apart from each other by natural elasticity when said plate swings back to said first stop when said adequate pressure is removed;

n. whereby applying momentarily said adequate pressure in the direction that brings said plate closer to said support causes the conductivity of said electrical path of the electronics of said watch to change momentarily and consequently causes the display of a selected set of data of said watch to appear.

2. In a watch system comprising a case containing most parts of the watch, a band attached to said case, means for securing said band around a wrist of a person, the electronics of said watch system requiring a momentary change in the conductivity of one electrical path to cause the display of a selected set of data of said watch to appear, a wrist actuator for said momentary change in the conductivity comprising:

a. a support made of one of the general classes of firm materials characterized by brass, stainless steel and hard plastics, having essentially the shape of a rectangle thereof the first two sides parallel to each other having length about the same as the width of said band and the two remaining sides are oriented essentially in the longitudinal direction of said band;

b. said support having essentially cylindrical bearings suitably formed at one of said first sides and longitudinally oriented in the same direction as said first sides;

c. said support having U-shaped formings at the other side of said first sides;

d. means for fastening said support to said watch system at a location between 45 degrees and 145 degrees from the case of said watch;

e. a plate made of one of the general classes of firm materials characterized by brass, stainless steel and hard plastics having essentially the shape of a thin-walled rectangular box thereof with one of the two largest sides missing;

f. means for fastening rotatably said plate to said bearings of said support to make them form essentially together a complete six-sided box;

g. spring means for permanently causing a swinging of said plate around said bearings and away from said support with suitable strength in the absence of any external force;

h. means for putting a first stop on said swinging at a suitable distance between said plate and said support, said means for putting said first stop being characterized by a retractable pin of adequate diameter fastened at its both ends onto said plate by means of apertures suitably provided for on said plate and the longitudinal part of said pin being caused to rest on the inside of one of the legs of said U-shaped formings by action of said spring means;

i. an essentially rectangular board of insulator thereof with one side fastened permanently by appropriate means on the outside of a leg of said U-shaped formings so that the opposite side of said side faces the inside surface of said plate;

j. said inside surface of said plate having a conducting surface fastened to said inside surface by suitable means;

k. a first wire electrically connected to said conducting surface;

l. said opposite side having fastened permanently thereto a piece of conducting material characterized by gold plated and silver plated material;

m. a second wire electrically connected to said piece of conducting material;

n. said first and second wires running through said six-sided box formed by said plate and said support up to the electronics of the watch to establish said electrical path;

o. said conducting surface touching said piece of conducting material if and only if there is pressure causing said plate to get closer to said support;

p. whereby applying momentarily adequate pressure in the manner to cause said plate to get closer to said support causes said conducting surface to touch said piece of conducting material to cause in turn the conductivity of said electrical path of the electronics of said watch to change momentarily and consequently causes the display of a selected set of data of said watch to appear.

* * * * *